US009303399B2

(12) United States Patent
Espinosa

(10) Patent No.: US 9,303,399 B2
(45) Date of Patent: Apr. 5, 2016

(54) HOLDER AND CONCRETE ANCHOR ASSEMBLIES

(71) Applicant: Thomas M. Espinosa, Snohomish, WA (US)

(72) Inventor: Thomas M. Espinosa, Snohomish, WA (US)

( * ) Notice: Subject to any disclaimer, the term of this patent is extended or adjusted under 35 U.S.C. 154(b) by 0 days.

(21) Appl. No.: 13/959,799

(22) Filed: Aug. 6, 2013

(65) Prior Publication Data

US 2014/0157717 A1 Jun. 12, 2014

Related U.S. Application Data

(60) Provisional application No. 61/679,985, filed on Aug. 6, 2012.

(51) Int. Cl.
*E04B 1/41* (2006.01)

(52) U.S. Cl.
CPC ..... *E04B 1/4114* (2013.01); *E04B 1/4121* (2013.01); *E04B 1/4157* (2013.01)

(58) Field of Classification Search
CPC .... E04B 1/4114; E04B 1/4121; E04B 1/4157
USPC ..... 52/699, 700, 704, 707, 708
See application file for complete search history.

(56) References Cited

U.S. PATENT DOCUMENTS

| | | | | |
|---|---|---|---|---|
| 991,517 A | | 5/1911 | Kennedy | |
| 1,045,562 A | | 11/1912 | Kennedy | |
| 1,185,765 A | | 6/1916 | Brooks | |
| 1,264,189 A | | 4/1918 | Keator | |
| 1,447,515 A | | 3/1923 | Miller | |
| 1,940,545 A | | 12/1933 | Holmes | |
| 2,096,062 A | * | 10/1937 | Phillips | 52/699 |
| 2,689,987 A | | 9/1954 | Berger | |
| 3,157,966 A | | 11/1964 | Sherburne | |
| 3,224,591 A | | 12/1965 | Sawyer | |
| 3,391,514 A | | 7/1968 | Hall, Jr. | |
| 3,405,497 A | * | 10/1968 | McNair | 52/699 |
| 3,443,351 A | | 5/1969 | Kumazawa | |
| 3,509,670 A | | 5/1970 | Boll et al. | |
| 3,514,917 A | | 6/1970 | Merrill, Sr. | |
| 3,517,470 A | | 6/1970 | Luebkeman | |

(Continued)

FOREIGN PATENT DOCUMENTS

| | | |
|---|---|---|
| WO | 2010/090736 | 8/2010 |
| WO | 2010/090748 | 8/2010 |

OTHER PUBLICATIONS

ISA/US, International Search Report and Written Opinion of the International Searching Authority, PCT/US13/53765, Mar. 10, 2014.

(Continued)

*Primary Examiner* — Adriana Figueroa
(74) *Attorney, Agent, or Firm* — Shlesinger, Arkwright & Garvey LLP

(57) ABSTRACT

A holder for a concrete anchor to be embedded in concrete, comprises base portion; a first sleeve portion vertically disposed above the base portion; post portions including vertical openings, the post portions including respective top edges for providing a shoulder to engage the nail heads when the nails are installed in the vertical openings. A concrete anchor assembly for being embedded in concrete, the assembly including the holder; and an anchor body held by the holder, the anchor body including a rod portion and a head portion.

26 Claims, 11 Drawing Sheets

(56) References Cited

U.S. PATENT DOCUMENTS

| | | | | | |
|---|---|---|---|---|---|
| 3,540,762 | A | | 11/1970 | Dunlap | |
| 3,579,938 | A | | 5/1971 | Hanson | |
| 3,782,061 | A | | 1/1974 | Minutoli et al. | |
| 3,867,804 | A | * | 2/1975 | Wilson | 52/699 |
| 3,884,004 | A | | 5/1975 | Douma et al. | |
| 3,927,497 | A | | 12/1975 | Yoshinaga et al. | |
| 3,935,685 | A | | 2/1976 | Howlett | |
| 4,169,569 | A | | 10/1979 | Riegler et al. | |
| 4,195,709 | A | | 4/1980 | Gianotti et al. | |
| 4,211,048 | A | * | 7/1980 | Naka | 52/700 |
| 4,239,489 | A | | 12/1980 | Ellmas et al. | |
| 4,250,681 | A | | 2/1981 | Helderman | |
| 4,287,807 | A | | 9/1981 | Pacharis et al. | |
| 4,325,575 | A | | 4/1982 | Holt et al. | |
| 4,408,940 | A | | 10/1983 | Fischer | |
| 4,650,276 | A | | 3/1987 | Lanzisera et al. | |
| 4,812,096 | A | | 3/1989 | Peterson | |
| 4,945,704 | A | | 8/1990 | Brown, Jr. | |
| 5,081,811 | A | | 1/1992 | Sasaki | |
| 5,085,547 | A | | 2/1992 | Vanotti | |
| 5,104,273 | A | * | 4/1992 | Clark | 411/85 |
| 5,205,690 | A | | 4/1993 | Roth | |
| 5,375,384 | A | | 12/1994 | Wolfson | |
| 5,415,510 | A | * | 5/1995 | Funaki et al. | 411/384 |
| 5,542,225 | A | * | 8/1996 | Endo et al. | 52/511 |
| 5,641,256 | A | | 6/1997 | Gundy | |
| 5,653,078 | A | * | 8/1997 | Kies et al. | 52/698 |
| 5,653,563 | A | | 8/1997 | Ernst et al. | |
| 5,740,651 | A | | 4/1998 | Vanotti | |
| 5,772,372 | A | | 6/1998 | Lins et al. | |
| 5,957,644 | A | | 9/1999 | Vaughan | |
| 6,135,687 | A | | 10/2000 | Leek et al. | |
| 6,161,339 | A | | 12/2000 | Cornett et al. | |
| 6,195,949 | B1 | | 3/2001 | Schuyler | |
| 6,240,697 | B1 | * | 6/2001 | Thompson et al. | 52/698 |
| 6,341,452 | B1 | | 1/2002 | Bollinghaus | |
| 6,350,093 | B1 | * | 2/2002 | Petersen et al. | 411/82.1 |
| 6,513,300 | B1 | | 2/2003 | James | |
| 6,904,728 | B2 | | 6/2005 | Stutts | |
| 7,080,486 | B2 | * | 7/2006 | Radke et al. | 52/98 |
| 7,093,400 | B1 | | 8/2006 | Thompson et al. | |
| 7,144,530 | B2 | | 12/2006 | Ward et al. | |
| 7,150,132 | B2 | | 12/2006 | Commins | |
| 7,174,679 | B1 | | 2/2007 | Mueller | |
| 7,296,382 | B2 | | 11/2007 | Sack | |
| 7,437,857 | B1 | * | 10/2008 | Maguire et al. | 52/298 |
| 7,445,192 | B2 | | 11/2008 | Gridley et al. | |
| 7,752,824 | B2 | | 7/2010 | Brown et al. | |
| 7,766,299 | B2 | | 8/2010 | Titus et al. | |
| 7,946,086 | B2 | | 5/2011 | Hammer et al. | |
| 7,971,411 | B2 | | 7/2011 | Commins | |
| 8,136,318 | B2 | | 3/2012 | Espinosa | |
| 8,186,924 | B1 | * | 5/2012 | Espinosa | 411/536 |
| 2002/0189175 | A1 | | 12/2002 | Lancelot et al. | |
| 2005/0055897 | A1 | | 3/2005 | Commins | |
| 2008/0302035 | A1 | * | 12/2008 | Shin | 52/223.13 |
| 2010/0290859 | A1 | * | 11/2010 | Noce et al. | 411/80.6 |
| 2010/0313517 | A1 | * | 12/2010 | Clinch et al. | 52/704 |
| 2011/0041449 | A1 | * | 2/2011 | Espinosa | 52/698 |
| 2011/0041450 | A1 | * | 2/2011 | Espinosa | 52/698 |
| 2011/0192111 | A1 | | 8/2011 | White et al. | |
| 2013/0067849 | A1 | * | 3/2013 | Espinosa | 52/699 |

OTHER PUBLICATIONS

Chainring Construction Products LLC, www.ptanchor.com, Copyright 2009 Home, PT Anchor, Concept and Cut Sheet pages.

* cited by examiner

FIG. 17
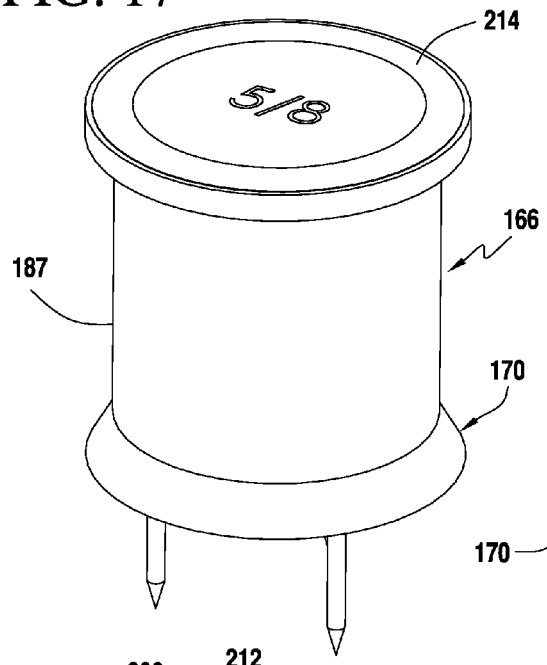
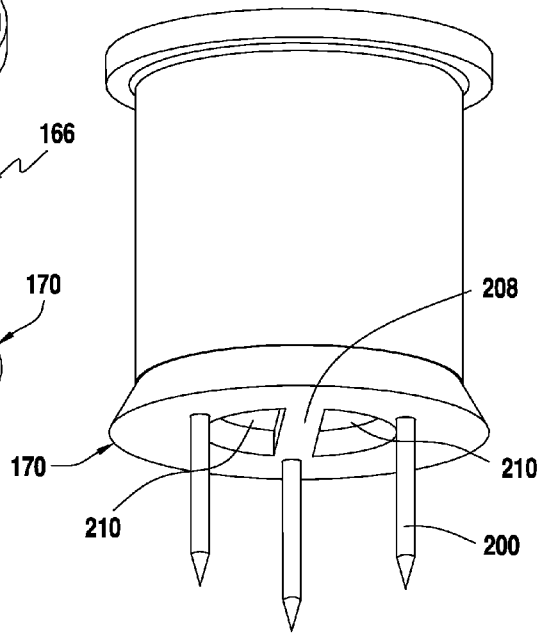
FIG. 18
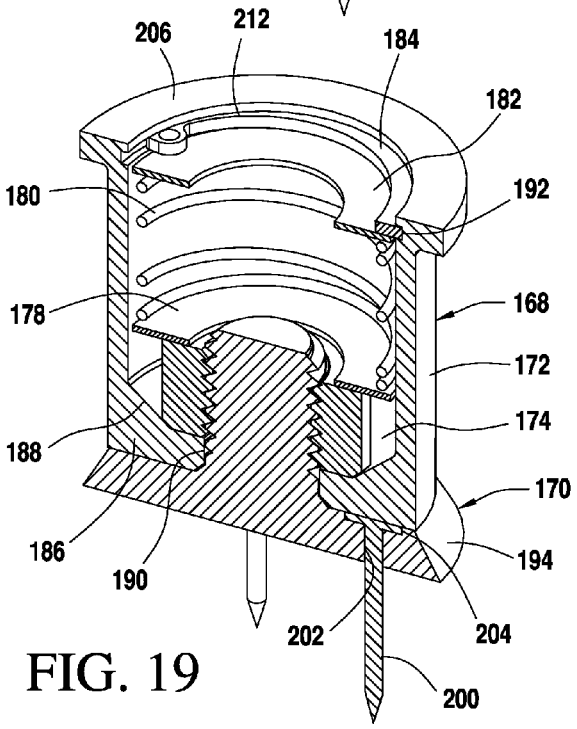
FIG. 19
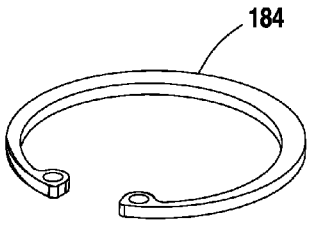
FIG. 20

HOLDER AND CONCRETE ANCHOR ASSEMBLIES

FIELD OF THE INVENTION

The present invention is generally directed to holders for concrete anchors for positioning the anchors on a concrete form surface prior to pouring concrete and concrete anchor assemblies including holders.

SUMMARY OF THE INVENTION

The present invention provides a holder for a concrete anchor to be embedded in concrete, comprising base portion; a first sleeve portion vertically disposed above the base portion; post portions including vertical openings, the post portions including respective top edges for providing a shoulder to engage the nail heads when the nails are installed in the vertical openings.

The present invention also provides a concrete anchor assembly for being embedded in concrete, the assembly comprising a holder; and an anchor body held by the holder, the anchor body including a rod portion and a head portion. The holder includes a sleeve portion and a base portion, the sleeve portion being vertically disposed above the base portion. The holder includes vertical openings and top edge. Nails are disposed in the respective vertical openings, the nails extending through the base portion. The nails include respective nail heads extending over and engaging the top edge. The head portion of the anchor body extends laterally from the rod portion, the head portion including an underside in direct contact with the nail heads.

The present further provides a concrete anchor assembly, comprising a housing having a top opening, the housing including a bottom wall with a bottom opening; the bottom wall including a ramp surface extending upwardly and away from the bottom opening; and a split nut disposed on the bottom wall and over the bottom opening. A spring is biased to force the split nut toward a bottom of the ramp surface.

BRIEF DESCRIPTION OF THE DRAWINGS

FIG. 17 is a top perspective view of another embodiment of a concrete anchor assembly embodying the present invention.

FIG. 18 a bottom perspective view of FIG. 17.

FIG. 19 is a perspective longitudinal cross-sectional view of FIG. 17.

FIG. 20 is a perspective view of a C-shaped spring clip used in the concrete anchor assembly of FIG. 19.

DETAILED DESCRIPTION OF THE INVENTION

A concrete anchor assembly 2 embodying the present invention is disclosed in FIGS. 1-4. The concrete anchor assembly 2 is embedded in concrete during a concrete pour. After the concrete has cured, the concrete anchor assembly 2 is used to connect to a threaded rod for supporting a load. An illustration of manner of use involving other concrete anchors is disclosed in U.S. application Ser. No. 13/424,082, filed on Mar. 19, 2012, hereby incorporated by reference.

Figure 3:
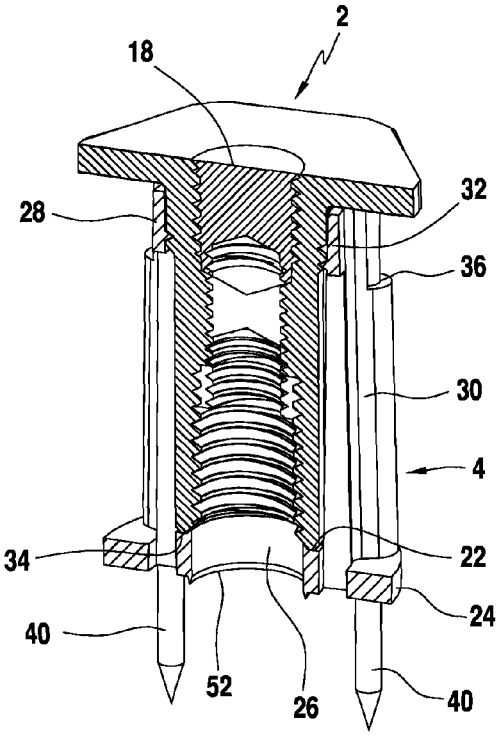
FIG. 3 is a cross-sectional perspective view of the concrete anchor assembly shown in FIG. 1.
Figure 4:
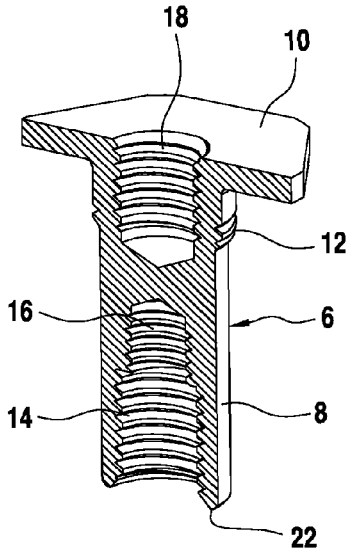
FIG. 4 is a cross-sectional perspective view of an anchor body used in the concrete anchor assembly shown in FIG. 1.

The concrete anchor assembly 2 comprises a holder 4 and an anchor body 6. The anchor body 6 includes a cylindrical rod portion 8 and a head portion 10 that extends outwardly of the cylindrical rod portion 8, as best shown in FIG. 3. Thread 12 is disposed at an upper end of the rod portion 8. The thread 12 is used to attach the anchor body 6 to the holder 4.

An internal threaded bore 14 is disposed at a bottom end of the rod portion 8. Another threaded bore 16 having a smaller diameter than the threaded bore 14 may be included above the threaded bore 14. Still another threaded bore 18 may be provided through the head portion 10. The threaded bores 14, 16 and 18 are preferably co-axial. The threaded bore 18 may be used to attach another anchor body, such as a threaded bolt, to increase the load capacity of the anchor body 6. The threaded bore 18 may also be used to attach a threaded rod, which is to be extended outside of the concrete mass, as for example disclosed in WO 2010/090748, hereby incorporated by reference. The threaded bore 18 preferably does not communicate with the threaded bores 14 and 16 to keep them sealed from the concrete slurry in case the threaded bore is not used. The smaller diameter threaded bore 16 may be used for lighter load with a smaller diameter threaded rod while the larger diameter threaded bore 14 may be used for larger diameter threaded rod for higher loads. The threaded rods are used to support loads, such as pipes hung from the ceiling of a concrete deck, anchor a wall section, etc.

Figure 5:
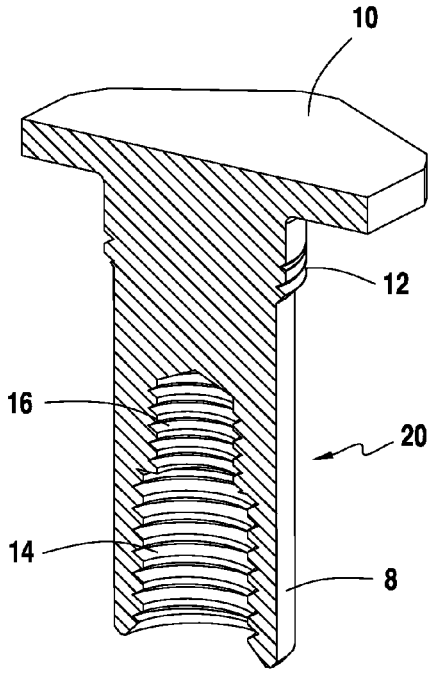
FIG. 5 is a cross-sectional perspective view of another embodiment of the anchor body shown in FIG. 4.

An anchor body 20 without the threaded bore 18 is shown in FIG. 5. All other features of the anchor body 20 are the same as those found in the anchor body 6 and are designated with like reference numerals.

The bottom edge 22 of the rod portion 8 is beveled to provide sealing contact against a confronting surface in the holder 4, as would be further explained below.

The anchor body 6 is embedded in concrete in such a way that the threaded bores 14 and 16 will be accessible for attachment of a threaded rod. The smaller threaded bore 14 or the larger threaded bore 16 may be used, depending on the load requiring a smaller or larger diameter threaded rod. The head portion 10 provides the anchoring function of the anchor body 6. For additional anchoring capacity, another anchor body, such as a standard bolt, may be attached to the threaded bore 18 prior to concrete pour. The threaded bore 18 may also be used to attach a threaded rod prior to concrete pour to support a load in the opposite direction from the load that may be supported by the threaded bore 14 or 16.

The holder 4 advantageously positions the anchor body 6 on a wood formboard such that after the concrete has cured and the formboard is removed, threaded bores 14 and 16 are accessible for attaching a threaded rod. See, for example, U.S. application Ser. No. 13/424,082.

Figure 1:
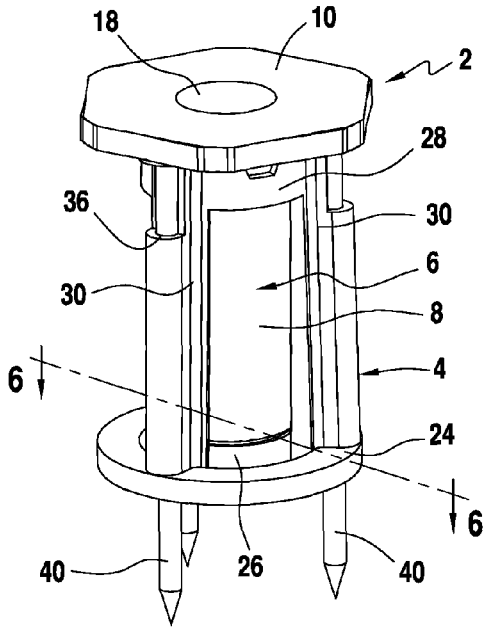
FIG. 1 is a top perspective view of a concrete anchor assembly embodying the present invention.
Figure 2:
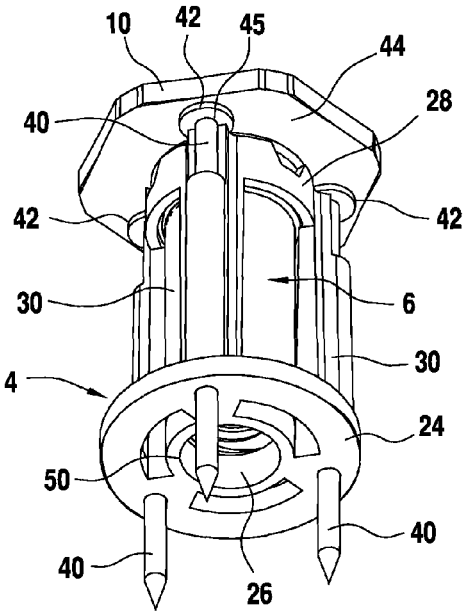
FIG. 2 is bottom perspective view of FIG. 1.

Referring to FIGS. 1-3, the holder 4 includes a base portion 24, a plug portion 26, a sleeve portion 28 and a plurality of post portions 30. The post portions 30 connect the base portion 24 to the sleeve portion 28. The plug portion 26 is in the form of a sleeve with an opening coaxial with the opening of the sleeve portion 28.

Referring to FIG. 3, the sleeve portion 28 includes inside thread 32 that cooperate with the outside thread 12 of the anchor body 6 to thereby secure the anchor body 6 to the holder 4. The thread 32 may be a single turn and segmented thread. The bottom edge 22 of the rod portion 8 engages a confronting top edge 34 of the plug portion 26 to provide a seal to prevent entry of the concrete slurry into the bores 14 and 16 during concrete pour.

Figure 6:
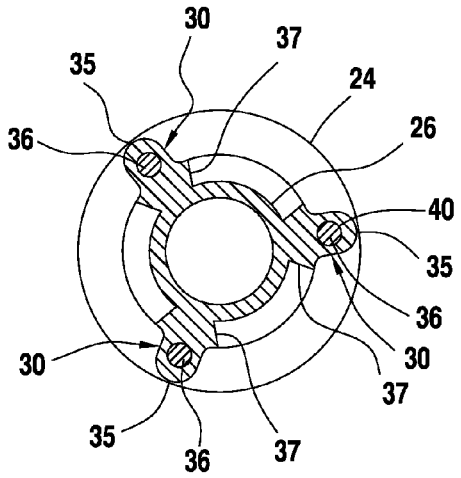
FIG. 6 is a cross-sectional view taken along line 6-6 in FIG. 1.

Referring to FIG. 6, the post portions 30 include respective vertical openings 36 for receiving respective nails 40 that are used to attach the holder 4 to the formboard. The post portions 30 further include respective tubular portions 35 with the openings 36 and base portions 37 connecting the sleeve portion 28 and the plug portion 26. The tubular portions 35 are attached to the respective base portions 37. The nails 40 extend downwardly from the base portion 24. The nail heads 42 are advantageously in direct contact with the bottom surface 44 of the head portion 10 of the anchor body 6, shown in FIG. 2, so that driving force applied to the head portion 10 is transmitted directly to the nail heads 42.

Preferably, three nails are used for stability during installation, but a different number may be used. The nails may or may not be pre-installed in the holder. The nails may be provided separate from the holder so that an installer will have to insert the nails in the respective holes prior to installation.

Figure 7:
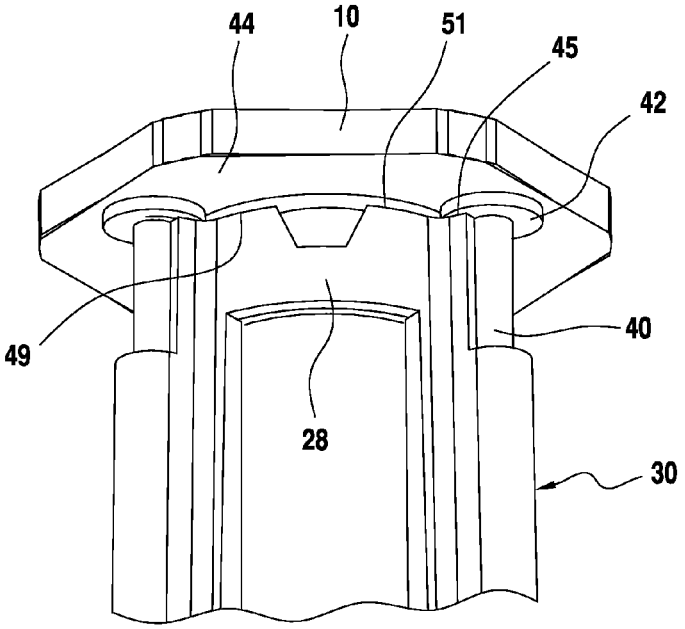
FIG. 7 is an enlarged fragmentary view of a portion of FIG. 2.

Referring to FIG. 7, the post portions 30 have respective top edges 45 that engage the undersides of the respective nail heads 42, providing a shoulder as a stop to always keep the nail head 42 in direct contact with the bottom surface 44 of the head portion 10. The top edges 45 are preferably in line with the top edge 49 of the sleeve portion 28 so that a gap 51 substantially equal to the thickness of the nail heads 42 is maintained between the bottom surface 44 and top edge 49. This advantageously insures that the bottom surface 44 is directly in contact with the nail head 42.

The concrete anchor assembly 2 is attached to the wood formboard by hammering the head portion 10. The hammering forces are then transmitted to the nail heads 42 by virtue of direct contact of the nail heads 42 with head portion 10, thereby driving the nails 40 into the formboard. Providing the concrete anchor assembly 2 complete with holder, anchor body and attaching nails in one package advantageously makes for an efficient installation.

Figure 8:
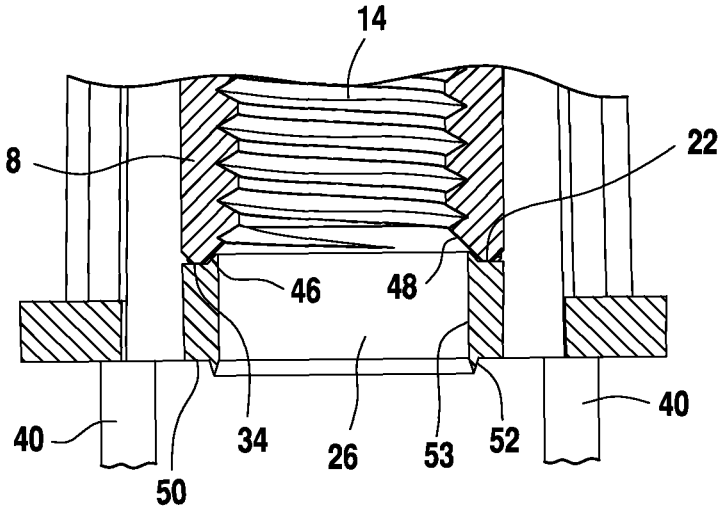
FIG. 8 is an enlarged cross-sectional view of the lower portion of FIG. 3, showing a sealing feature.

Referring to FIG. 8, the top edge 34 of the plug portion 26 includes a ramp surface 46 that engages a beveled surface 48 on the bottom edge of the rod portion 8. Contact between the surfaces 46 and 48 advantageously reduces entry of the concrete slurry between the bottom edge 22 of the anchor body 6 and the top edge 34 of the plug portion 26 during a concrete pour.

The bottom surface 50 of the plug portion 26 includes a circumferential V-shaped projection 52 disposed around the opening 53 that digs into the formboard surface when the concrete assembly 2 is installed, thereby sealing the bores 14 and 16 from the concrete slurry during concrete pour.

Figure 9:
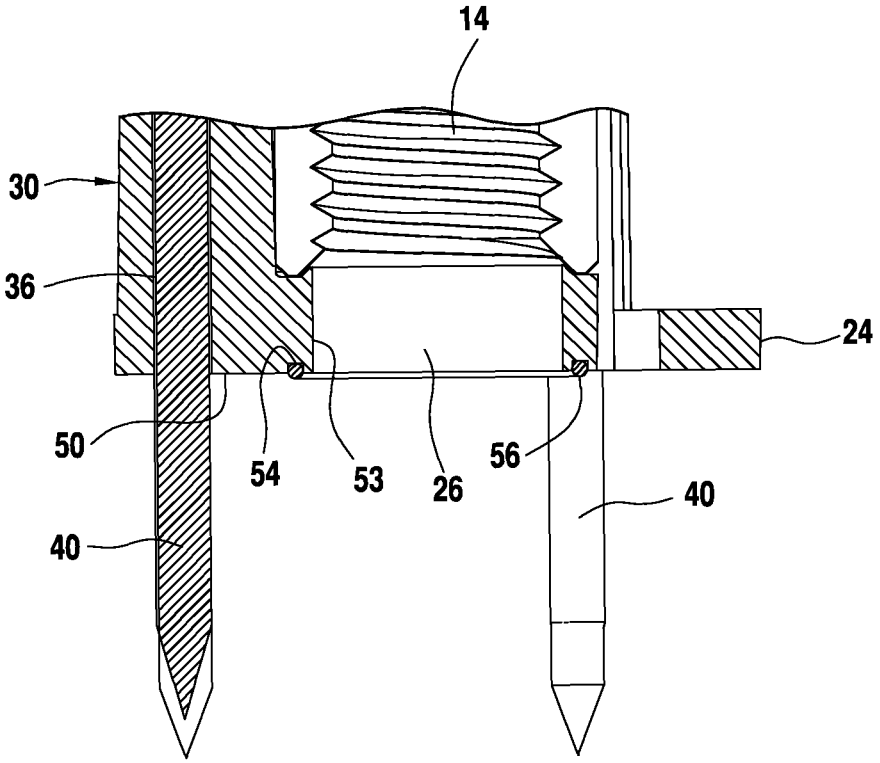
FIG. 9 is another embodiment of the sealing feature shown in FIG. 8.
Figure 10:
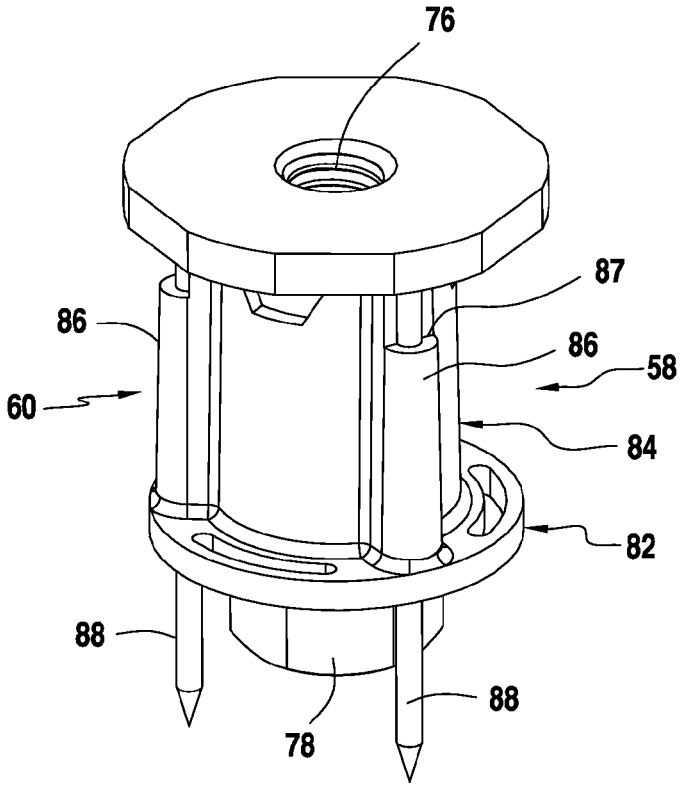
FIG. 10 is a perspective view of another embodiment of a concrete anchor assembly embodying the present invention.

Referring to FIG. 9, the projection 52 may be replaced with an O-ring 54 disposed in a groove 56 on the bottom edge 50 of the plug portion 26. The O-ring 54 is configured to seal the opening 53 from the concrete slurry.

Another embodiment of a concrete anchor assembly 58 is disclosed in FIGS. 10-13. The assembly 58 includes a holder 60 and an anchor body 62. The anchor body 62 includes a rod portion 64 and a head portion 66. The rod portion 64 includes outside threads 68 and 70. The outside thread 68 is preferably larger in diameter than the outside thread 70. The anchor body 62 also includes inner threaded bores 72 and 74. The inner threaded bore 74 is advantageously larger in diameter than the threaded bore 72.

The head portion 66 may include a threaded bore 76 for connection to another anchor body, such as a standard bolt, or to a threaded rod for connection to a load outside the concrete mass in which the anchor assembly 58 is embedded. A nut 78 may be attached to the anchor body 62 via the outside thread 70 and the inside thread 71 after the concrete has cured and the formboard to which the anchor assembly 58 was attached has been removed, thereby making accessible the outside thread 70. The nut 78 includes another thread 80 having a diameter larger than the diameter of the inner thread 74. The use of the nut 78 gives the anchor body 62 the capability to accept one of three different sized threaded rods. This gives the anchor assembly 58 maximum flexibility for supporting different loads requiring different diameter threaded rods from the anchor body 62.

The head portion 66 extends outwardly and transversely from the rod portion 64 to provide the anchorage function within the concrete mass in which the anchor assembly 58 is embedded.

Referring back to FIG. 10, the holder 60 includes a base portion 82, a sleeve portion 84 connected to the base portion 82 and post portions 86 including vertical openings 87 for receiving and vertically positioning respective nails 88.

Referring back to FIGS. 11 and 13, the sleeve portion 84 includes an upper portion 90 with internal thread 92 that engage the outside thread 68 on the anchor body 62. The sleeve portion 84 also includes a lower portion 94 with an internal diameter adapted to receive the nut 78 when attached to the anchor body 62. The lower portion 94 may include an inside diameter larger than the inside diameter of the upper portion 90 if needed to accommodate the nut 78.

Figure 12:
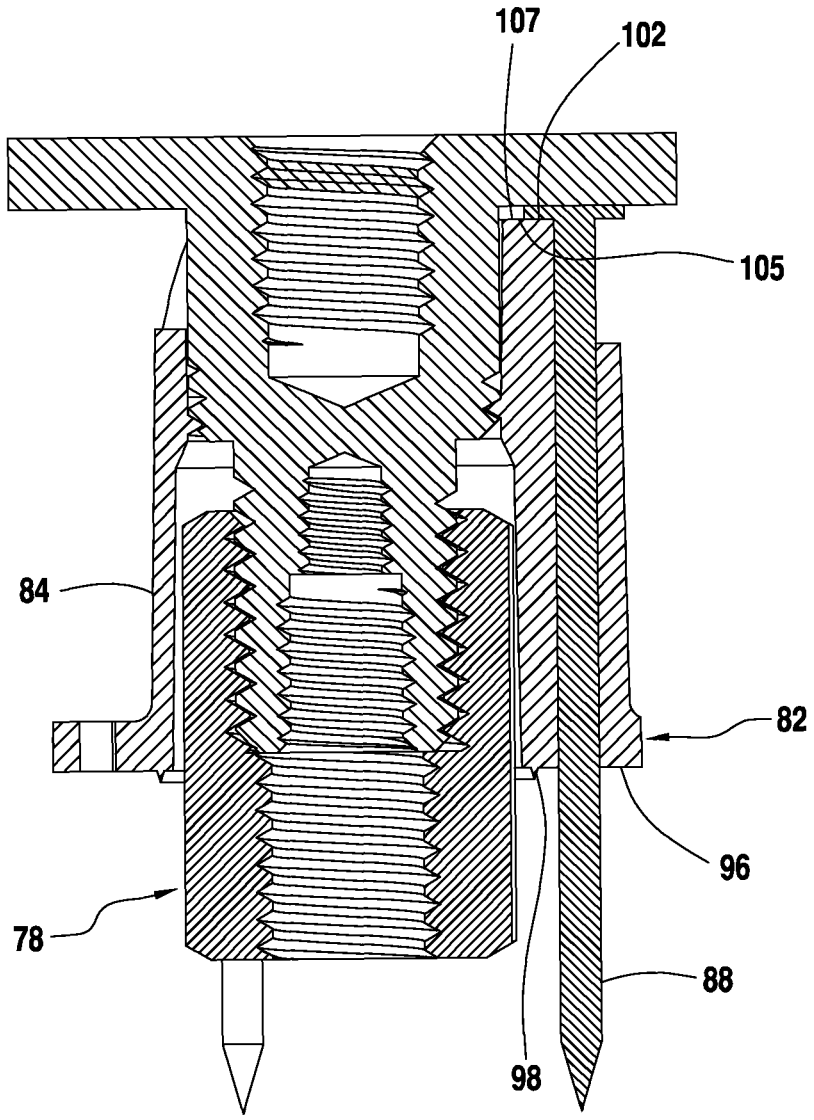
FIG. 12 is an elevational cross-sectional view of FIG. 11.
Figure 13:
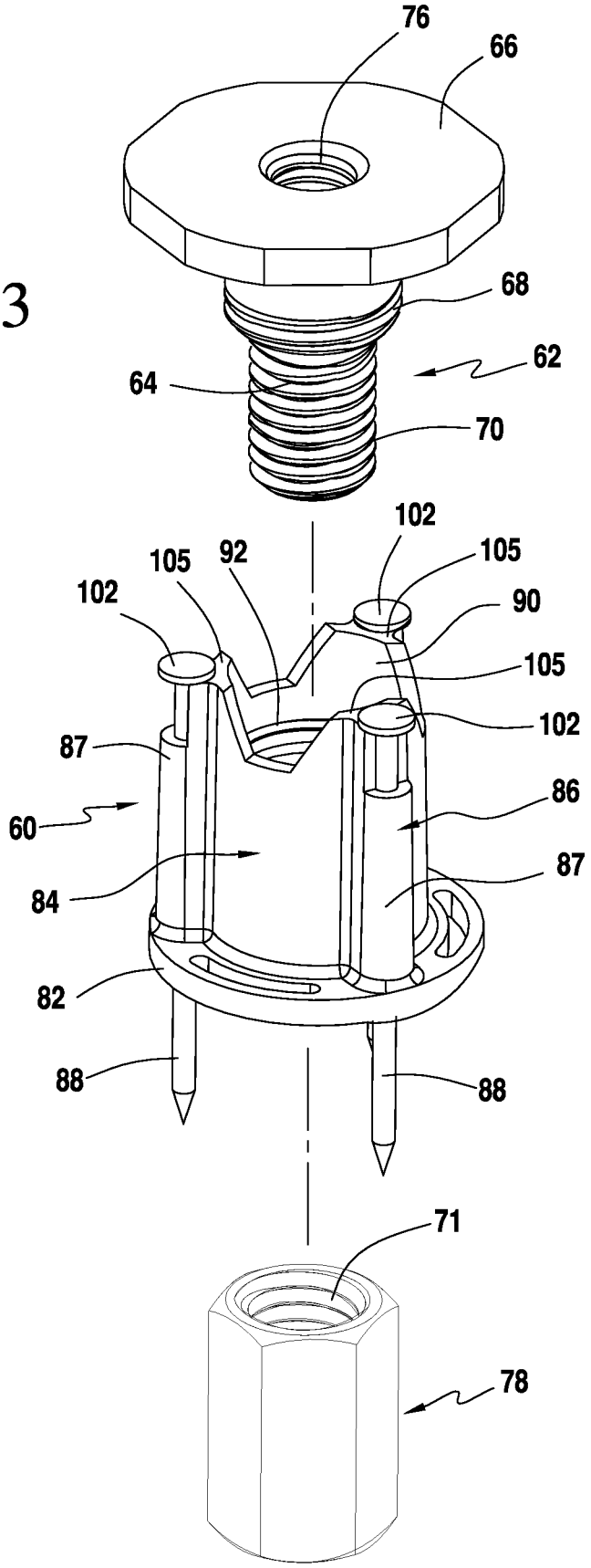
FIG. 13 is an assembly view of FIG. 10.

Referring to FIG. 12, the base portion 82 includes a bottom surface 96 with a V-shaped projection 98 around the peripheral edge of the opening 100 of the sleeve portion 84. The projection 98 extends downwardly from the bottom surface 96 such that when the assembly 58 is attached to the formboard (without the nut 78), the projection 98 will be depressed into the wood formboard, thereby to seal the opening 100 from the concrete slurry during concrete pour.

Figure 11:
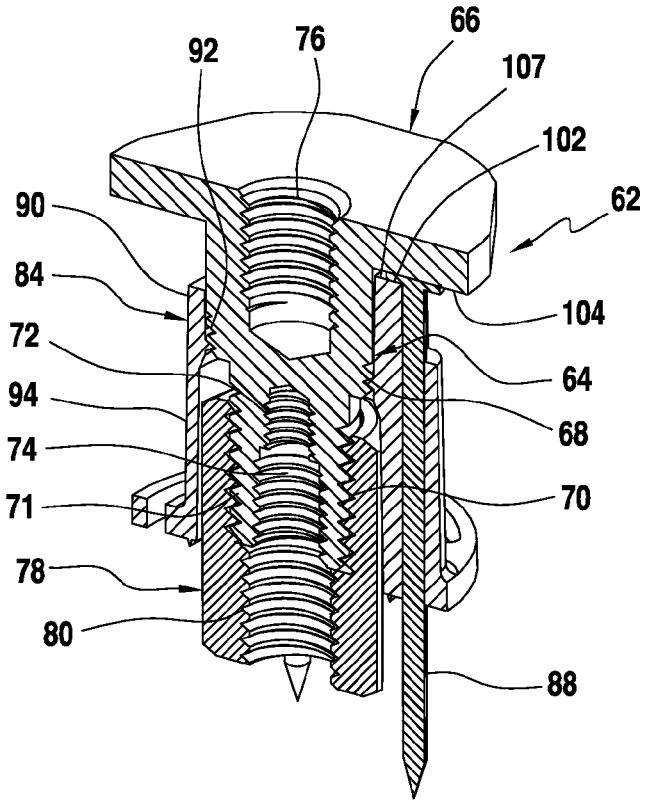
FIG. 11 is a perspective longitudinal cross-sectional view of FIG. 10.

Referring to FIG. 11, each of the nails 88 includes a nail head 102 that is in direct contact with an underside 104 of the head portion 66. Top surfaces 105 provide respective stops for the nail heads 102 so that when the anchor body 62 is screwed into the holder 60, the underside 104 will contact the nail heads 102. A gap 107 substantially equal to the thickness of the nail heads 102 is maintained between the top surfaces 105 and the underside 104 to insure that hammer blows to the head portion 66 are transmitted directly to the nail heads 102 to efficiently drive the nails 88 into the formboard. The nut 78 will normally not be attached to the anchor body 62 when attaching the anchor assembly 58 to the formboard. A person of ordinary skill in the art would appreciate that directly hammering on the nail heads 102, with the anchor body 62 out of the way, may also be used in attaching the holder 60 to the formboard. The placement of the nail heads 102 on the stops 105 advantageously makes the nail heads 102 visible throughout the time the holder 60 is being attached to the formboard.

Figure 14:
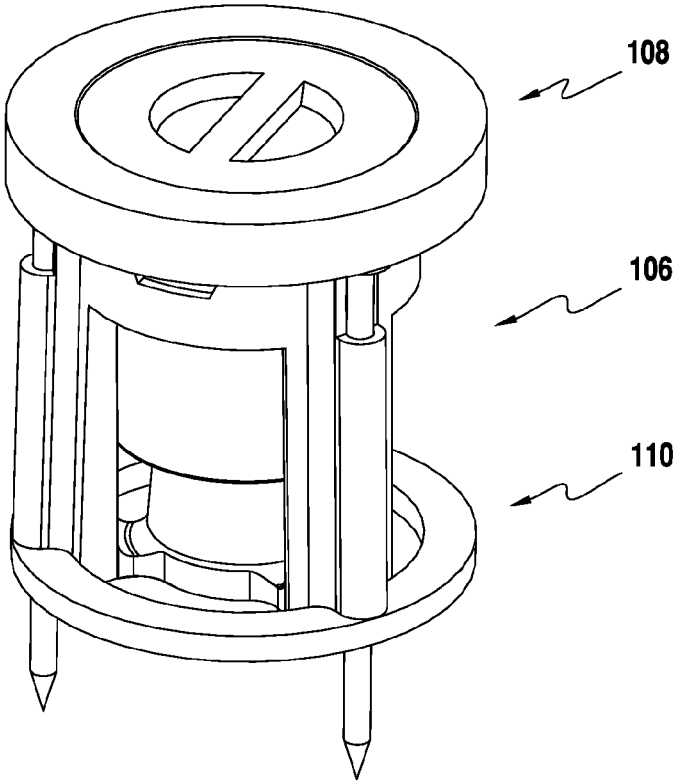
FIG. 14 is a perspective view of another embodiment of a concrete anchor assembly embodying the present invention.
Figure 15:
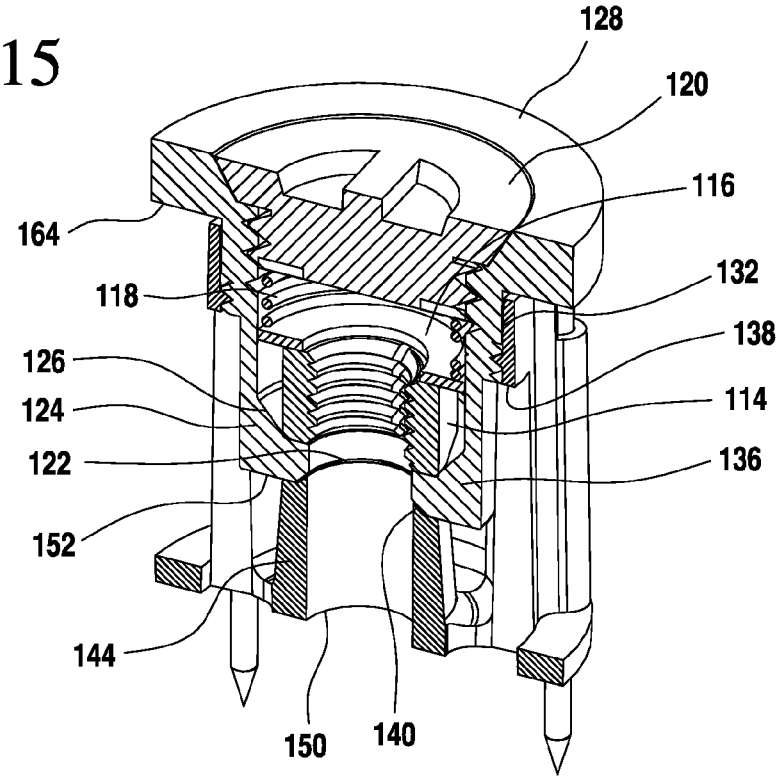
FIG. 15 is a perspective longitudinal cross-sectional view of FIG. 14.
Figure 16:
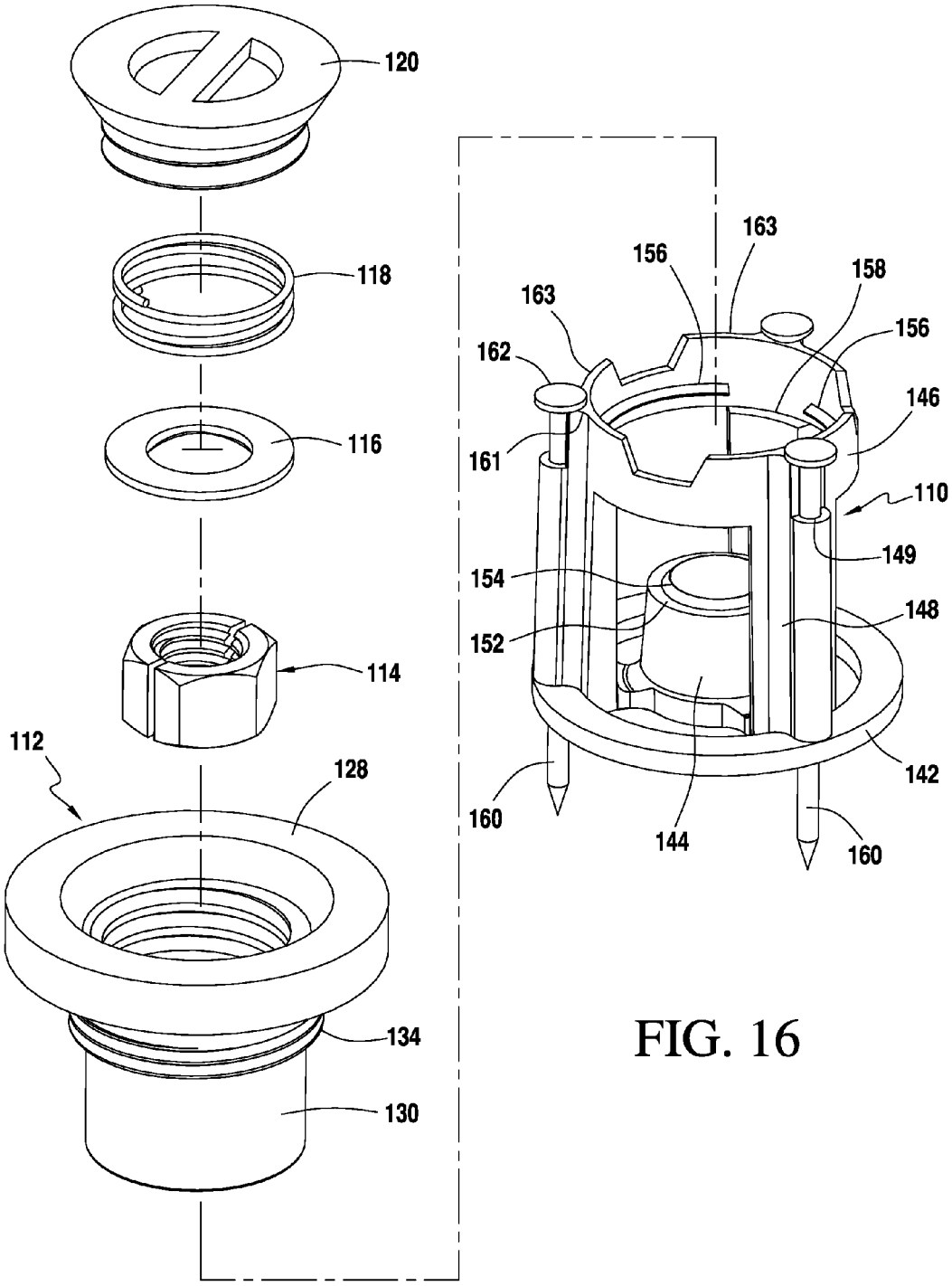
FIG. 16 is an assembly view of FIG. 14.

Referring to FIGS. 14-16, another embodiment of a concrete anchor assembly 106 is disclosed. The concrete anchor assembly 106 includes an anchor body assembly 108 and a holder 110. The anchor body assembly 108 includes a housing 112, a split nut 114, a washer 116, a spring 118 and a cap 120.

The housing 112 has an opening 122 and a bottom wall 124 for supporting the split nut 114. The bottom wall 124 has an internal ramp surface 126 on which the split nut 114 will rise up when a threaded rod is axially forced into the split nut 114 through the opening 122. The cover 122 is threaded into the housing 112 to bias the spring 118 against the washer 116 to thereby bias or force the split nut 114 unto the bottom of the ramp surface 126. The housing 112 includes a circumferential flange portion 128 that extends outwardly and transversely from a vertical cylindrical wall portion 130 of the housing 112. The flanged portion 128 provides the anchorage function of the anchor assembly 106 when embedded in concrete.

The wall portion 130 has an upper cylindrical portion 132 provided with thread 134. A lower portion 136 of the wall portion 130 may be of a smaller diameter than the upper wall portion 132 such that a shoulder 138 is created.

The bottom peripheral edge of the opening 122 includes a bevel surface 140 that mates with a corresponding surface on the holder 110.

The holder 110 includes a base portion 142, a plug portion 144 attached to the base portion 142, a sleeve portion 146 and a plurality of post portion 148 with vertical openings 149. The plug portion 144 includes an opening 150 that lines up with the opening 122 in the housing 112. The bottom peripheral edge of the opening 150 may include the projection 52 or the O-ring 54 to seal the interior of the plug portion 144 from the concrete slurry during concrete pour. A top edge 152 of the plug portion 144 includes a beveled surface 154 that mates with the corresponding beveled surface 140 on the housing 130 to provide sealing contact to minimize or prevent entry of the concrete slurry into the housing 130 during concrete pour. The sleeve portion 146 includes a single turn segmented thread 156 for cooperating with the thread 134 on the housing 112. Shoulders 158 at a bottom portion of the sleeve portion 146 are provided as a stop to engage the shoulder 138 on the housing 112 when the housing 112 is screwed into the holder 110. The vertical openings 149 locate the nails 160 vertically. The nail heads 162 extend over the top edge 161 of the post portions 148 that act as stops for the nail head 162. The top edges 161 preferably are on the same level as the top edges 163 of the sleeve portion 146 such that the top of the nail heads will always engage the undersurface 164 of the flanged portion 128. With this arrangement, the nail heads 162 will be in direct contact with flange portion 128 when the housing 112 is screwed into the holder 110.

To attach the assembly 106 to a formboard, the cap 120 is struck with a hammer, whereby the impact forces are transmitted to the nail heads 162, which are in direct contact with the underside 164 of the flanged portion 128. The anchor assembly 106 may also be attached to the formboard by removing the anchor body assembly 108 from the holder 110, thereby exposing the nail heads 162, which are struck by a hammer to drive the nails 160 into the formboard. Positioning the nail heads 162 on the top edges 161 insures that the nail heads 162 will remain exposed above the sleeve portion 146 during installation.

Another embodiment of a concrete anchor assembly 166 is disclosed in FIGS. 17-21. The assembly 166 includes an anchor body assembly 168 and a holder 170.

The anchor body assembly 168 includes a housing 172, a split nut 174, a washer 178, a spring 180, a washer 182 and a C-shaped spring clip 184.

The housing 172 includes a bottom wall 186 with a ramp surface 188 on which the split nut 174 rises upwardly when a threaded to be attached to the split nut 174 is pushed upwardly through an opening 190 after the concrete has cured, the formboard is removed to expose the holder 170 and the holder is removed. The spring clip 184 is disposed in a groove 192 inside the housing 172. The spring 180 is under tension to urge the split nut 174 towards the bottom of the ramp surface 188.

The housing 172 has cylindrical wall 187 with a circumferential flange portion 206 that extends outwardly transversely from the wall 187.

The holder 170 includes a base portion 194 and a threaded projection 196 that attaches to the split nut 174. A plurality of nails 200 are carried by the base portion 194 through respective vertical holes 202. The nails 200 extend vertically downwardly from the base portion 194. The nail head 204 are advantageously disposed underneath the bottom wall 186 and are in direct contact therewith so that hammer blows to the circumferential flange portion 206 are transmitted directly to the nails heads 204 thereby to drive the nails 200 into the formboard, which forms part of the concrete form. After the concrete dries, the formboard is removed, exposing the bottom of the base portion 194 and the protruding nails 200. A rib member 208 and recesses 210 advantageously allow a rotary powered tool, such as a drill with a yoke bit, to engage the rib member 208 and unscrew the holder 178 and remove it from the split nut 174.

The housing 172 has a top opening 212 which may be closed off by a tape 214 or other standard means.

Figure 21:
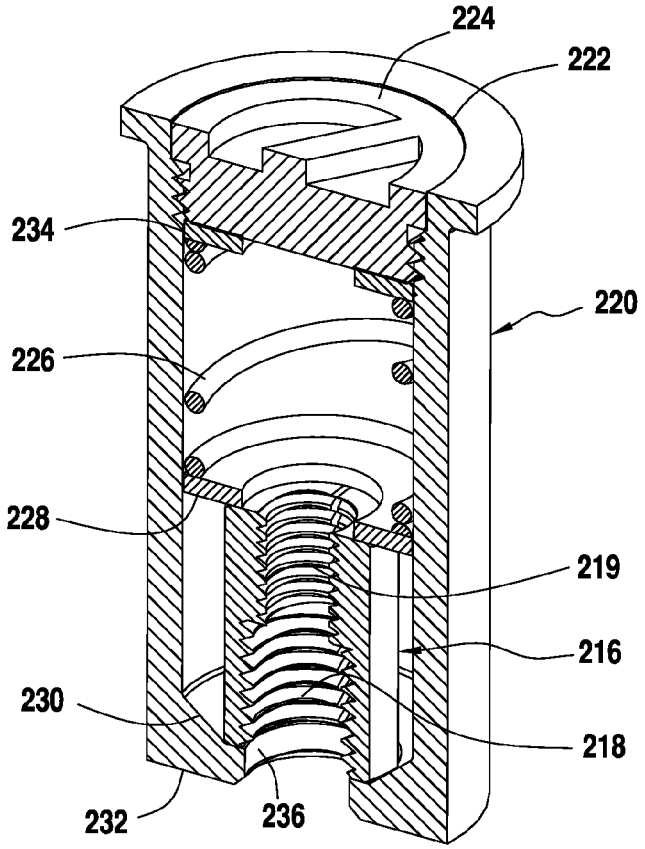
FIG. 21 is a perspective longitudinal cross-sectional view of another embodiment similar to FIG. 17.

A split nut 216 with different diameter threads 218 and 220 is disclosed in FIG. 21. The split nut 216 allows for the use of different diameter threaded rods as may be dictated by the load for a particular application. The split nut 216 is disposed within the housing 220 with the top opening 222 closed off by a cover 224. The opening 222 is used for assembling the components within the housing 220. A spring 226 urges the split knot 216 via washer 228 at the bottom of a ramp surface 230 on a bottom wall 232 of the housing 220. A washer 234 may be used to facilitate the turning of the cover 224 when closing the opening 222.

When a threaded rod is axially pushed into the opening 236 at the bottom wall 232, the split nut will be pushed up on the ramp surface 230, further compressing the spring 226 and enlarging the threaded openings 218 and 219. When the upward force on the threaded rod ceases, the spring 226 will force the split nut downwardly along the ramp surface 230 to thereby close around and engage the thread of the threaded rod.

Further, the various features described in one embodiment may be applied to the other holder embodiments disclosed herein.

Figure 22:
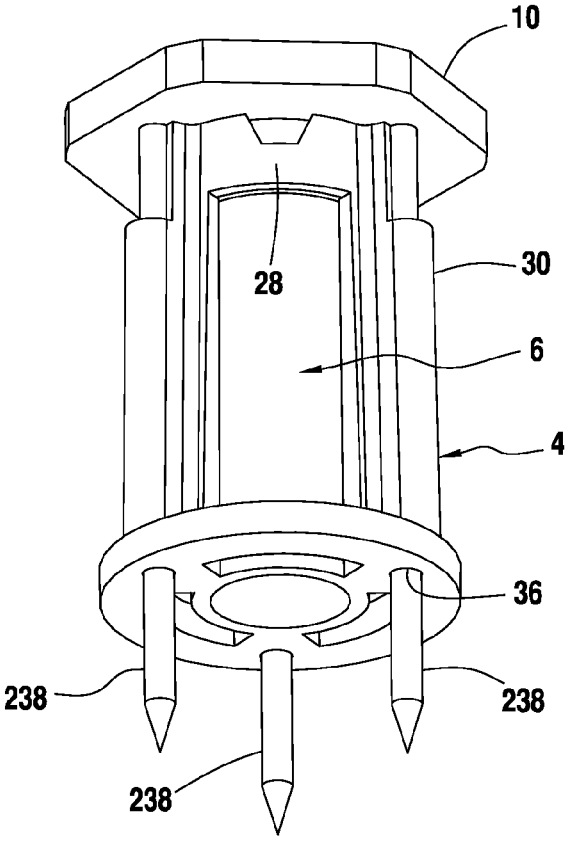
FIG. 22 is a perspective view of another embodiment of the concrete anchor assembly shown in FIG. 1.

Referring to FIG. 22, the nail heads 42 shown in FIG. 2 may be removed, leaving the nails 40 with only the shafts 238 showing. The nail shafts 238 may be secured to the underside of the head portion 10, if needed, by glue, welding, or other standard means. In this embodiment, force applied to the head portion 10 is transmitted directly to the nail shafts 238. The threads 12 on the anchor body 6 or 20 and the inside threads 32 in the sleeve 28 my be eliminated in this embodiment. The nail shafts 238 are frictionally held in the vertical openings 36 of the post portions 30 as shown in FIG. 9. The sleeve 28 may also be frictionally attached to the rod portion 8 of the anchor body 6 or 20.

Figure 23:
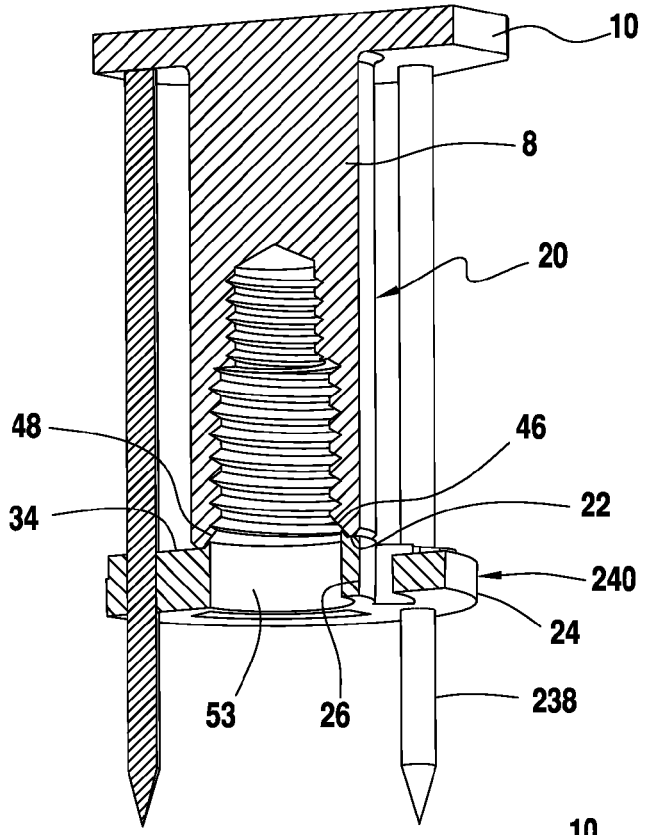
FIG. 23 is a perspective cross-sectional view of an embodiment of the concrete anchor assembly shown in FIG. 22.

Referring to FIG. 23, the embodiment of FIG. 22 is further modified. An embodiment of a holder 240 is disclosed. The holder 240 is similar to the holder 4 disclosed above except that the holder 240 only includes the base portion 24 and the plug portion 26 of the holder 4. The holder 240 includes the plug portion 26 with the central opening 53. The top edge 34 of the plug portion 26 includes a ramp surface 46 that engages a beveled surface 48 on the bottom edge of the rod portion 8. Contact between the surfaces 46 and 48 advantageously reduces entry of the concrete slurry between the bottom edge 22 of the anchor body 6 and the top edge 34 of the plug portion 26 during a concrete pour. As in the embodiment of the concrete anchor assembly 2, the nail shafts 238 protrude through the base portion 24. The nail shafts 238 are frictionally attached to the base portion 24 to hold the holder 240 to the anchor body 20. It should be understood that embodiment of FIG. 23 may also include the threaded bore 18 shown in FIG. 4.

Figure 24:
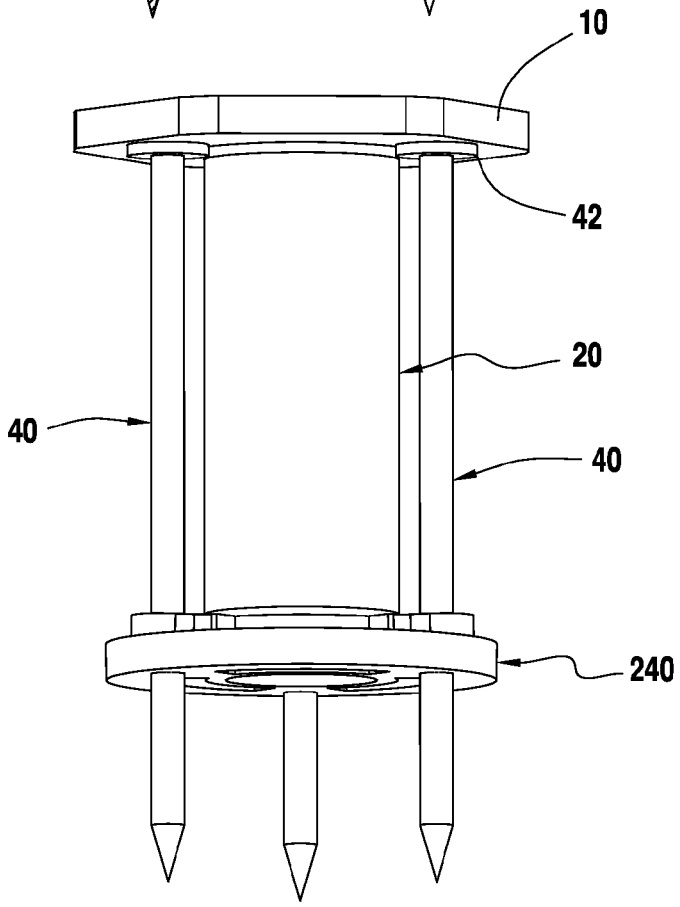
FIG. 24 is a perspective view of another embodiment of the concrete anchor assembly shown in FIG. 23.

Referring to FIG. 24, the embodiment shown in FIG. 23 is further modified. The nails 40 include respective heads 42, which may be attached to the underside of the head portion 10, if needed, by glue, welding, or other standard means.

It should be understood by a person skilled in the art that the various features described in one embodiment may be applied to the other embodiments disclosed herein.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A holder for a concrete anchor to be embedded in concrete, comprising:

a) a one-piece body including a base portion and a first sleeve portion;

b) said first sleeve portion is vertically disposed above said base portion with openings therebetween;

c) said body including post portions attached to said first sleeve portion, said post portions connecting said first sleeve portion to said base portion, said post portions including vertical openings for holding respective nails, said post portions including respective top edges; and d) said first sleeve portion including an inside threaded surface for threaded attachment to a rod portion of the concrete anchor.

2. A holder as in claim 1, wherein said first sleeve portion includes a cylindrical interior surface.

3. A holder as in claim 1, wherein said inside threaded surface includes a single turn thread.

4. A holder as in claim 3, wherein said thread is segmented.

5. A holder as in claim 1, and further comprising:

a) a plug portion attached to said base portion, said plug portion being coaxial with said sleeve portion; and b) said plug portion including a second sleeve portion having an opening coaxial with said first sleeve portion.

6. A holder as in claim 5, wherein:

a) said second sleeve portion includes an upper edge surface; and b) said upper edge surface includes a ramp surface extending upwardly and inwardly toward said opening.

7. A holder as in claim 5, wherein:

a) said second sleeve portion includes a bottom surface having a circumferential projection around said opening; and b) said circumferential projection extending downwardly from said bottom surface.

8. A holder as in claim 7, wherein said circumferential projection is v-shaped in cross-section.

9. A holder as in claim 5, wherein:

a) said second sleeve portion includes a bottom surface having a circumferential groove around said opening; and b) a seal disposed in said groove.

10. A holder as in claim 1, wherein said post portions are disposed outside said first sleeve portion.

11. A holder as in claim 1, wherein said post portions extend between said first sleeve portion and said base portion.

12. A holder as in claim 1, wherein:

a) said post portions include respective tubular portions; and b) said vertical openings are disposed in said tubular portions.

13. A concrete anchor assembly for being embedded in concrete, said assembly comprising:

a) a holder;

b) an anchor body held by said holder, said anchor body including a rod portion with an outside thread and a head portion;

c) said holder including a sleeve portion and a base portion, said sleeve portion is vertically disposed above said base portion with openings therebetween, said sleeve portion including an inside threaded surface;

d) post portions connecting said sleeve portion to said base portion;

e) said holder including vertical openings for holding respective nails; and f) said outside thread of said rod portion is threadedly attached to said inside threaded surface of said sleeve portion.

14. A concrete anchor assembly as in claim 13, wherein said sleeve portion inside threaded surface includes a single turn segmented thread.

15. A concrete anchor assembly as in claim 13, wherein said rod portion includes an internally threaded bore.

16. A concrete anchor assembly as in claim 13, wherein said rod portion includes multiple diameter threaded bores.

17. A concrete anchor assembly as in claim 13, wherein said head portion includes a threaded bore.

18. A concrete anchor assembly as in claim 15, and further comprising:

a) a nut including first and second threads;

b) said first thread for threading to said rod portion;

c) said second thread having a major diameter larger than a major diameter of said internally threaded bore; and d) said second thread having a major diameter less than a major diameter of said outside thread.

19. A concrete anchor assembly as in claim 13, wherein:

a) said holder includes a plug portion;

b) said anchor body includes a threaded bore having a bottom edge; and c) said plug portion includes an opening and a top edge that engages said bottom edge.

20. A concrete anchor assembly as in claim 19, wherein said base portion includes a bottom surface having a seal around said opening to seal said threaded bore from concrete slurry during concrete pour when said holder is attached to a formboard.

21. A concrete anchor assembly as in claim 20, wherein said seal includes a projection adapted to dig into a formboard when said holder is attached to the formboard.

22. A concrete anchor assembly as in claim 20, wherein said seal includes an O-ring disposed in a groove in said bottom surface.

23. A concrete anchor assembly as in claim 13, wherein said post portions include respective top edge aligned on a same level as a top edge of said sleeve portion.

24. A concrete anchor assembly as in claim 23, wherein said top edge of said sleeve portion is spaced apart from said underside of said head portion.

25. A holder as in claim 1, and further comprising:

a) nails disposed in said respective vertical openings, said nails extending through said base portion;

b) said nails including respective nail heads; and c) said nail heads extend over and engage respective said top edges.

26. A concrete anchor assembly as in claim 13, and further comprising:

a) nails disposed in respective said vertical openings, said nails extending through said base portion;

b) said nails including respective nail heads;

c) said nail heads extending over and engaging respective top edges of said openings; and d) said head portion of said anchor body extending laterally from said rod portion, said head portion including an underside in direct contact with said nail heads.

* * * * *